US005083789A

United States Patent [19]

Hickson

[11] Patent Number: 5,083,789

[45] Date of Patent: Jan. 28, 1992

[54] GOLF STANCE ALIGNMENT AND TRAINING DEVICE

[75] Inventor: Roy Hickson, Proctor, Ark.

[73] Assignee: Hick-O Industries, Inc., West Memphis, Ark.

[21] Appl. No.: 670,899

[22] Filed: Mar. 18, 1991

[51] Int. Cl.[5] ..... A63B 69/36

[52] U.S. Cl. ..... 273/187 R; 273/188 A

[58] Field of Search ..... 273/187 R, 187 A, 187 B, 273/183 A, 188 A

[56] References Cited

U.S. PATENT DOCUMENTS

| | | | |
|---|---|---|---|
| 3,229,981 | 1/1966 | Taber | 273/187 R |
| 3,244,421 | 4/1966 | Hanna | 273/187 R |
| 3,868,116 | 2/1975 | Ford et al. | 273/187 R |
| 4,257,608 | 3/1981 | Funk | 273/187 R |
| 4,538,815 | 9/1985 | Poirier | 273/187 R |
| 4,647,048 | 3/1987 | Welch | 273/187 R |
| 4,784,393 | 11/1988 | Williams et al. | 273/187 R |

FOREIGN PATENT DOCUMENTS

| | | | |
|---|---|---|---|
| 2149310 | 6/1985 | United Kingdom | 273/187 R |

*Primary Examiner*—George J. Marlo
*Attorney, Agent, or Firm*—Stephen D. Carver

[57] ABSTRACT

A teaching and practice device for improving a golfer's swing and alignment that eliminates sway. An extensible base adapted to be placed upon the playing surface is adjusted to the desired playing width and positioned substantially parallel with the desired target line. The base comprises a pair of axially displaceable brackets that can be moved with respect to each other to dispose the base at a desired length, normally the width of the golfer's shoulders. Each of the base brackets comprises a horizontal portion for contacting the playing surface and an integral vertical portion. The vertical portions comprise elongated slots adapted to be registered with one another to facilitate length adjustments. Foot control arms pivotally associated with the base at its opposite ends firmly contact the outside edges of the golfer's feet and prevent improper leg movement during the golf swing. The arms are disposed in either a folded position, in which they project towards each other and slidably contact the base, or a deployed position in which they angularly project away from the base. The first arm normally assumes an obtuse angle with respect to the base when deployed, and the second arm normally projects at a right angle when deployed. A ball positioner projects outwardly from the base towards the ball between the arms.

3 Claims, 2 Drawing Sheets

GOLF STANCE ALIGNMENT AND TRAINING DEVICE

BACKGROUND OF THE INVENTION

This invention relates generally to devices for training golfers to assume a proper stance. More particularly, the present invention is related to golf stance training devices of the type adapted to be disposed upon a playing surface and comprising one or more frame members for aiding and aligning the club swing. The invention is believed best classified in United States Class 273, Subclass 187R.

The development of a proper golf swing can be a long and arduous process. The many variables in properly aiming a golf ball and swinging a golf club can be particularly vexatious to a beginner. As will be recognized by those skilled in the sport of golf, a proper golf swing involves so many variables that it is almost intimidating for a beginner starting to learn the proper techniques. Even advanced and intermediate golfers have problems maintaining skills once learned. Further, because of the number of factors involved, it can be difficult, vexatious, and time consuming for skilled professionals to teach students.

Although there is divided opinion on the subject, most golf professionals agree that a golf swing begins with the development of a proper grip. When a student learns a proper grip and becomes comfortable with one or more of his clubs, the subject of alignment is often taught next. It is important to develop reliable and proper alignment and stance routines, so that the golfer has a point of reference for making corrections when subsequent shots miss the target. A good starting point for alignment purposes is to position one's feet such that a line drawn between the front of the feet runs parallel with the target line between the ball and the target itself. The foot closest to the target is usually oriented approximately 120 degrees from the reference target line. The ball is positioned forward of the target line, often in line with the heel of the golfer's foot closest to the target.

The proper width of the stance at a starting point is assumed to be approximately equal to the distance between the golfer's shoulders. Further, a basic reference starting point is to position the ball in line with one's left heel as aforedescribed for aligning the woods, in particularly the driver, including the long irons. The ball is moved further back in the stance for medium and shorter irons, and for some people the foot spacing may be varied as well. While it is recognized that no particular golf training aid can absolutely solve all problems for all people because of the numerous variables involved such as body size, weight and build, an ideal reference point can be achieved for all golfers.

As a golfer becomes more experienced in developing his swing and stance, a number of pointers are important. First, the proper foot spacing and stance must be developed. It is important that once the club swing begins, a weight transfer takes place. When the club is removed during the "take-away" phase from the ball and thereafter "cocked" for a subsequent shot, weight is transferred to that foot furthest from the target. As the shot progresses, weight will be transferred towards that foot closest to the target as the club rotates around the body of the golfer. When the shot is completed, he should end up with virtually all of his weight on that foot. At the same time, it is important to control the bending of the legs, to develop a proper balance, and to swing consistently thus creating more solid contact.

Leg movement must be proper to enable enhancement of the swinging art, but excessive leg movement can result in sway, the tendency to shift "outside" the back foot on the back swing. Once excessive sway occurs, the tendency of the golfer to become unstable as he attempts to swing the club through its arc becomes increased. Excessive leg movement can further result in improper arm and shoulder movement. For example, while it is known that the arm closest to the target should remain straight and follow through to the target, excessive leg movement and improper sway can interfere with the ability to move one's arms properly. Further, the very difficult concept of generating a proper "release" with the wrist of the hands, particularly in a drive, is greatly aggravated by improper leg movement and excessive sway. Finally, it will also be recognized by skilled golf professionals that improper leg movement and excessive sway can result in constantly varying positions in the club face upon ball contact, as well as irregular openings and closings of the club face relative to the ball.

The prior art reflects a number of attempts at golf stance teaching devices. Among the more relevant prior art known to me is R. E. Taber U.S. Pat. No. 3,229,981 issued Jan. 18, 1966. That device comprises a system for aiming a golf ball in which a pair of arms pivotally disposed on opposite ends of a central frame member help align the feet of the user for subsequent swinging contact with the ball. This unit functions in a substantially different manner, because of balance. The manner in which the unit is adjusted and set up and the manner in which contact between the user's feet and arms is established is substantially different.

Crowley U.S. Pat. No. 2,150,580 issued Mar. 14, 1939 discloses a generally horizontal frame member spaced apart from another parallel frame member by a vertical member that essentially establishes ball positioning relative to the heel of that foot closest to the target.

McDorman U.S. Pat. No. 4,563,010 discloses a swing system in which mirrors are used to attempt to aid in visualizing a swing. As will be recognized by many golf professionals, it is important to concentrate on the ball during the development of a swing rather than mirrors or other mechanical aids adjacent the ball. The golf training apparatus of Forbes U.S. Pat. No. 4,925,192, issued May 15, 1990, discloses a primary element laid horizontally substantially parallel with the golf target line. Means are provided on opposite sides of the parallel member for securing the device to the ground, and some foot contact is arranged with the side members. Further, a vertical member movably associated with the primary frame member establishes the ball location and permits adjustments for different clubs.

Similarly Cachola U.S. Pat. No. 4,384,718, issued May 24, 1983 discloses a device in which individual frame members lying parallel with the target direction are employed to help the user place his feet and develop a proper swing. I consider such devices unsatisfactory because of the unbalanced nature of the latter two devices, and because they ignore the aforementioned weight transfer and sway problems. My experiments with devices of this general nature indicate that they do not properly function to develop the swing with proper weight transfer.

U.S. Pat. No. 3,638,950 issued to Hyotlaine on Feb. 1, 1972 shows a stance gage in which a horizontal member disposed generally parallel to the target line is employed in conjunction with a pointer device projecting forwardly therefrom. However, the system for providing stance balance that I have proposed has been overlooked Similarly, Graham U.S. Pat. No. 1,517,555, Ford U.S. Pat. No. 3,868,116, Taylor U.S. Pat. No. 3,041,075, Guendling U.S. Pat. No. 4,544,161, and Miner U.S. Pat. No. 4,544,160 employ one or more horizontal and vertical frame members interconnected for alignment purposes for golf training. Numerous prior art devices show a centrally disposed horizontal member aligned generally with a target line and one or more members which are connected therewith. However, an overall design that preserves the balance of the user and prevents excessive leg movement through foot control arms in the manner I have proposed has not yet been addressed by the prior art.

Other prior art golf training devices of lesser relevance are seen in U.S. Pat. Nos. 4,023,810, 4,895,372, 4,919,433, 4,915,387, 4,919,432, 3,940,144, and 4,037,847.

SUMMARY OF THE INVENTION

My invention comprises a Golf Stance Teaching Device for improving a golfer's swing and body alignment. In particular, my device establishes proper leg control and develops a proper swing by eliminating the sway associated with known prior art devices.

In the best mode, my device comprises an extensible base adapted to be placed upon the playing surface. As will be appreciated by those skilled in the art, a golfer develops a proper aiming routine by learning to sight the ball towards the target, and aligning his feet somewhat parallel with that target line. Using the device, the golfer positions the extensible base substantially parallel with the desired target line, so that it contacts the heels of the golfer to properly align the feet. The base preferably comprises a pair of axially displaceable brackets that can be moved with respect to each other to dispose the base at a desired length.

Each of the base bracket members is preferably comprised of angled aluminum. Each piece thus comprises a horizontal portion for contacting the playing surface and an integral vertical portion. Each of the vertical portions comprises an elongated slot, and the slots are adapted to be aligned and registered with one another so that the two brackets slide relative to one another. Alignment is facilitated by a fastener removably inserted through the registered slots. Normally, the base is adjusted to correspond to the width of the golfer's shoulders. When the base is first extended to a length approximating the width between the golfer's shoulders, the fastener may be tightened to dispose it in the proper space.

Foot control arms are pivotally associated with the base at its opposite ends. These arms firmly contact the outside edges of the golfer's feet and prevent improper leg movement during development of the swing. In other words, the weight of the golfer will be confined within his stance during the swing, so that improper leg movement is resisted, and a proper weight transfer from the outside foot to that foot closest to the target is developed.

The foot control arms are each pivotally associated with the outer ends of the individual base brackets. The arms may be disposed in either a folded position, in which they project towards each other and slidably contact the base, or a deployed position in which they angularly project away from the base. The first arm normally assumes an obtuse angle with respect to the base. In other words, when a right-handed golfer places his left foot against it, his foot will be disposed approximately thirty degrees relative to a vertical line perpendicular to the target line. The second arm is pivotally associated with the base at the opposite side and normally projects at a right angle. A space is defined by the unit between the outwardly projecting arms and the front of the ball positioner to define a region in which the golfer's center of gravity and weight are confined.

A ball positioner projects outwardly from the base towards the ball. The pointer at the end of the positioner is approximately adjacent the tee upon which the ball is placed for hitting. The positioner is preferably aluminum, and terminates in a rearwardly upwardly depending flange removably coupled to the registered slots in the base brackets. The positioner therefore may be moved as desired, so that the golfer may position the ball further back in the stance. As will be appreciated by skilled golfers, the ball is normally positioned in alignment with the rear heel of that foot closest to the target for woods and long irons. The ball is usually moved back further in the stance for medium and short irons. My design allows the pointer to be positioned as desired for any club between the driver and the sand wedge.

Thus a basic object of the present invention is to provide a golf stance alignment device which properly develops leg movement and controls sway.

More particularly, it is an object of my invention to provide a passive golf swing practice device that restricts movement of the foot and heel during swinging momentum changes.

Another basic object of the present invention is to provide a golf training device of the character described which helps develop a proper weight transfer, which is so important to the swing.

A fundamental object of the present invention is to provide a golf training device of the character described which properly aligns the feet of the golfer with the direction of the intended shot.

A still further object of the present invention is to provide a golf training device of the character described which is easily disposed in either a transportable mode or a play mode.

A basic object of the present invention is to provide a golf training device of the character described which aids in maintaining constant balance and improved weight transfer.

A similar related object of the present invention is to provide a golf training aid of the character described which does not interfere with eye-hand coordination, or concentration of the golfer during practice.

A further object of the present invention is to provide a golf training device that can be used by golfers of different ages, physical attributes and with different playing skills and experience.

Another object of the present invention is to provide a golf training device of the character described which helps the golfer properly position his club head at impact and develop proper aim and trajectory.

A still further object is to provide a golf training aid of the character described which can be conveniently and quickly adapted for use with short, medium, and long irons, for various woods, and for the wedges.

Another basic object of the present invention is to provide a golf training aid of the character described to reduce sway by maintaining weight in the middle of the stance during the middle of the swing.

Still another object of the present invention is to provide a golf training device that develops proper weight transfer during the swing in which the weight is maintained within the playing region defined by the unit.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
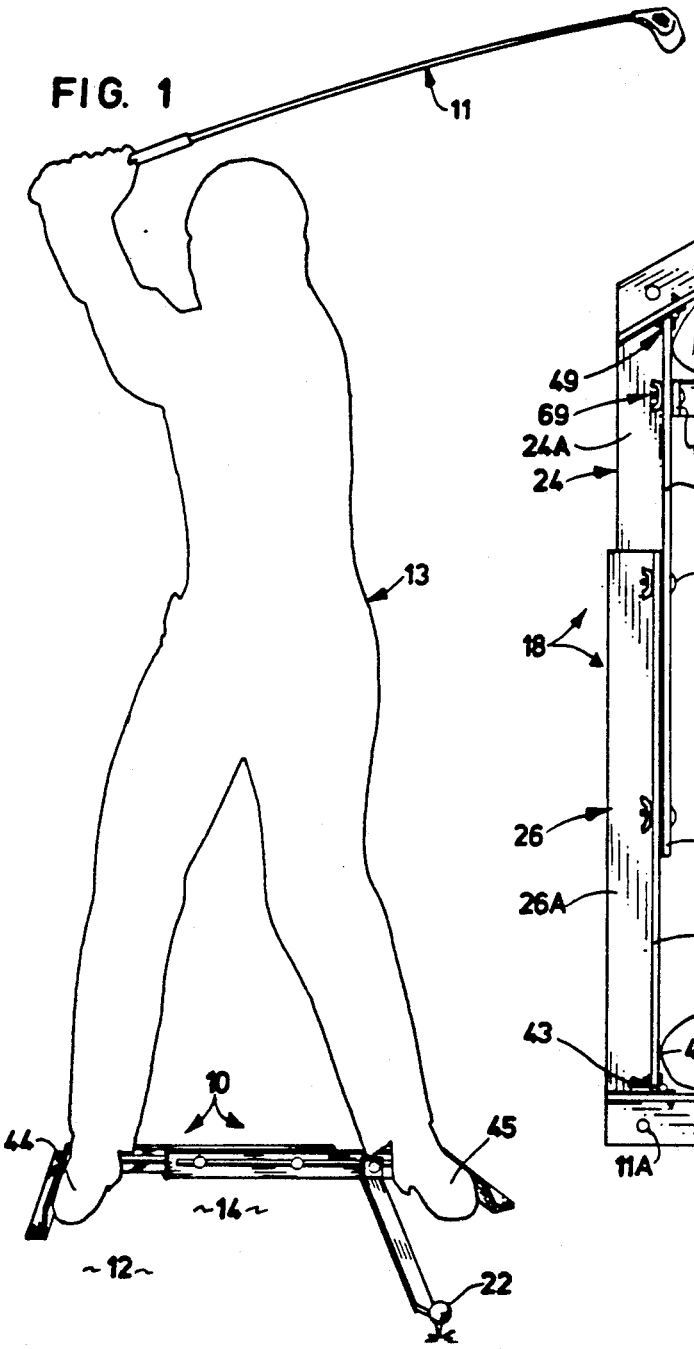
FIG. 1 is a perspective view showing my golf stance practice device deployed in the training mode, in which a golfer is shown properly aimed with his club in the backswing position immediately prior to hitting the ball.
Figure 2:
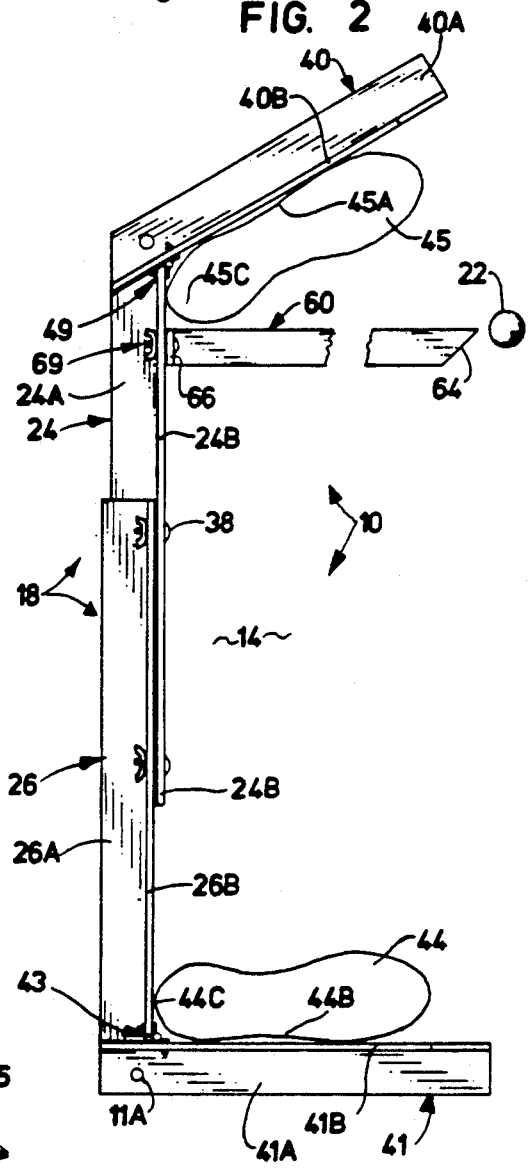
FIG. 2 is an enlarged, fragmentary, top plan view of the device in the deployed position, with the golfer's feet shown properly disposed.
Figure 6:
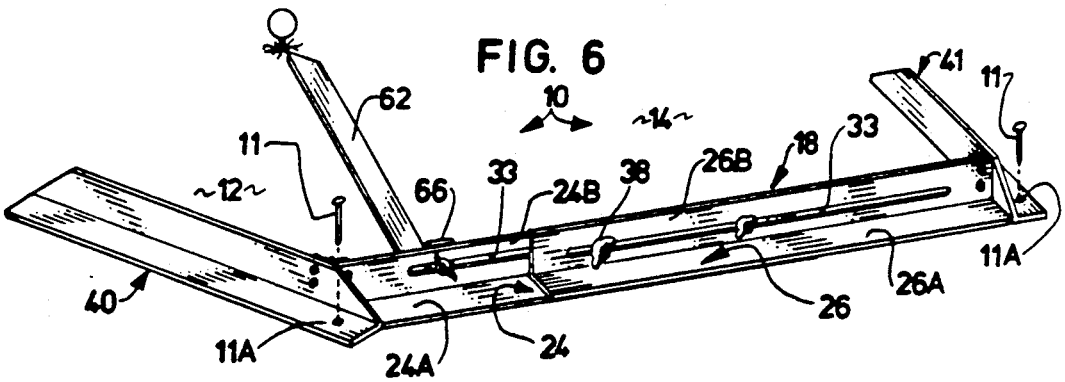
FIG. 6 is a fragmentary, rear perspective view thereof.

With initial reference to FIGS. 1 and 2 of the appended drawings, my golf stance alignment and training device has been generally designated by the reference numeral 10. As best seen in FIG. 1, the device 10 is adapted to be disposed upon a playing surface 12 (normally the ground, golf course practice area, driving range or the like). The unit is adapted to be pinned to the ground with pins or fasteners 11 placed through orifices 11A (FIG. 6). With the use of the device 10, the golfer 13 may practice his swing and develop proper body weight shift and control. When the golfer swings, his weight will be confined within the inside region of the device, generally designated by the reference numeral 14. In this fashion sway will be reduced, and the chances of developing a proper golf swing are greatly enhanced.

Figure 7:
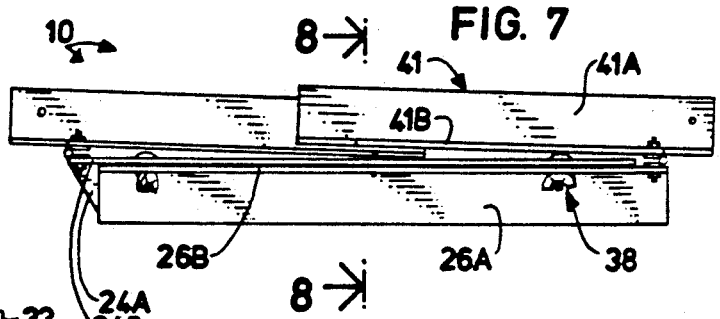
FIG. 7 is a top plan view showing the device in the folded position for shipping; and, FIG. 8 is an enlarged, fragmentary, sectional view taken generally along line 8—8 of FIG. 7, which illustrates alignment of the various components when the device is in the folded position.
Figure 8:
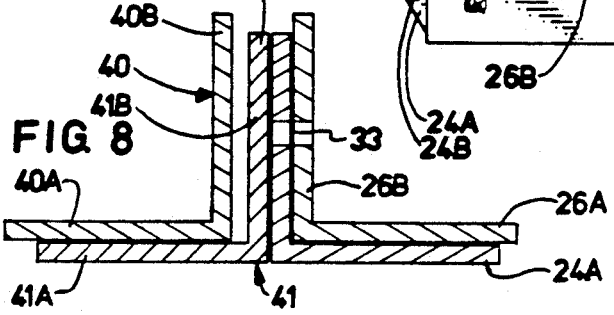

With additional reference now to FIGS. 3–8, device 10 comprises an extensible base, generally designated by the reference numeral 18, which is adapted to be disposed upon the ground. As seen in the drawings, the base is oriented substantially parallel with a target line 20 (FIG. 3) drawn between the golf ball 22 and the target (not shown). Base 18 comprises a pair of elongated angle brackets 24 and 26 which are of a similar right angular cross section (FIG. 8). Each bracket comprises a horizontal portion 24A or 26A integral with an upwardly projecting vertical portion 24B, 26B. The vertical portions 24B, 26B each include elongated slots 33 of similar dimensions which, as best viewed in FIG. 8, are normally aligned to permit insertion of an adjustment-facilitating fastener, such as wing nut assembly 38. Thus as may be appreciated from FIG. 5, the base may be lengthened by simply loosening the wing nut fastener assembly 38, and axially displacing the angle brackets 24 and 26 with respect to each other. When elongation or contraction occurs, relative displacements are facilitated by the slots 33 that permit clearance for the wing nut assembly 38.

On opposite ends of the base are foot control means that contact the feet 44, 45 of the golfer. As best seen in FIG. 1, left foot 45 is assumed to be closest to the target if golfer 13 is a right-handed golfer. It will be appreciated that the structure may be adapted for left-handed golfers as well. Foot control arms 40 and 41 each comprise elongated lengths of angled aluminum. As best viewed in FIGS. 2 and 8, foot control arms 40, 41 comprise lower horizontal portions 40A, 41A and upright vertical portions 40B, 41B. Arm 41 is pivotally linked to the base bracket 26 through a hinge structure 43. Thus, when disposed in the deployed position of FIGS. 2 and 6, for example, arm 41 forms an approximately ninety degree angle relative to the target line 20 and the axis of the base 18. Arm 41 controls foot 44. Specifically, foot side 44B abuts the upwardly oriented side 41B of arm 41, and the heel 44C contacts the base, being nested against vertical portion 26B of bracket 26.

Foot control 40 is pivotally connected at the opposite end of the base by hinge system 49. When deployed, it forms an obtuse angle 51 (FIG. 3) of approximately 120 degrees relative to base 18 and target line 20. However as seen in FIG. 2, foot control arm 40 controls foot 45, and its edge 40B contacts the side 45A of foot 45, which is the foot closest to the target. Heel 45C of foot 45 is similarly wedged into contact with vertical portion 24B of base bracket 24. This permits the foot closest to the target to form the familiar "30-degree" angle relative to a line projecting perpendicularly from the golfer towards the target line 20.

Figure 3:
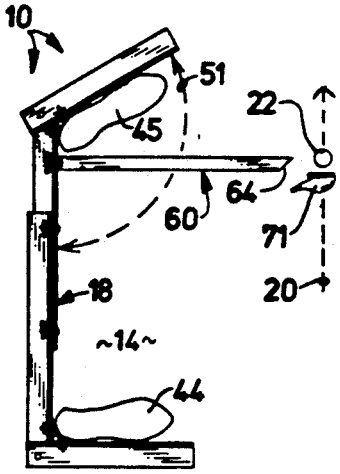
FIG. 3 is a reduced scale, top plan view similar to FIG. 2, illustrating the proper stance assumed for use of a driver.
Figure 4:
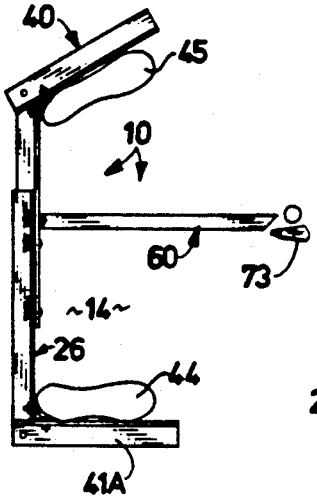
FIG. 4 is a reduced scale, top plan view similar to FIG. 3, but illustrating the proper stance assumed for use of a mid-iron.
Figure 5:
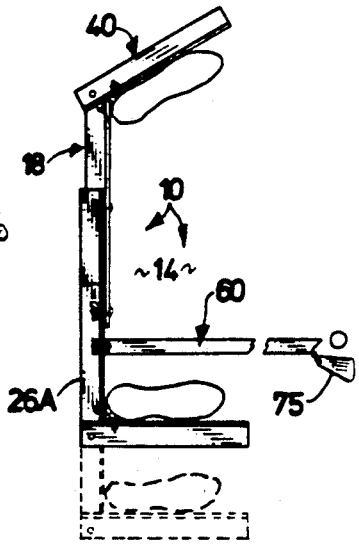
FIG. 5 is a reduced scale, top plan view similar to that of FIG. 4, illustrating one proper stance assumed for use of a sand wedge, and with dashed lines indicating alternative or moved positions.

The positioner 60 projects horizontally forwardly from the base 18. In the best mode, positioner 60 comprises a flat piece of aluminum 62, projecting between a forward point 64 (FIGS. 2, 3) disposed beneath the base of the golf ball 22 to be hit, and an upwardly turned terminal flange portion 66. Flange portion 66 is secured within slot 33 by a conventional wing nut fastener system 69. It may thus be moved within either slots 33 to varying positions, as illustrated by comparison of FIGS. 3 through 5. In FIG. 3, the positioner 60 is moved somewhat to the left, very close to foot 45 closest to the target. With the pointer end 64 disposed near the golf ball 22 as shown, the classical driver position will be achieved. In this position, the golf club 11 may be swung such that the driver head 71 will make proper contact with the ball 22. As seen in FIG. 4, the positioner 60 has been moved somewhat to the right, to accommodate a mid-iron 73. Similarly in FIG. 5, it has been moved further away from the target to accommodate a wedge 75.

With reference now to FIGS. 2, 6, 7, and 8, it is important that the device be adapted to be simply folded into a deployable position for shipping. For shipping purposes, ball positioner 60 is removed merely by unfastening the wing nut system 69. Wing nut assemblies 38 are similarly loosened, so that the base may be contracted by sliding bracket 26 and 24 together. As best viewed in FIG. 8, 24, 26 nest comfortably together. However, prior to contraction of the base, each of the arms 40, 41 fold over to project towards each other as seen in FIG. 7. When the base is contracted together, arms 40, 41 mesh with one another to align and position themselves as seen in FIG. 8. Thus, the volume is greatly reduced, so that the device may be conveniently stored for shipping.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A golf training device comprising:

extensible base means adapted to be disposed on a playing surface behind the golfer and oriented substantially parallel with a desired target line for contacting the heels of the golfer and establishing alignment with a target, said base means comprising a pair of elongated brackets axially displaceable with respect to each other and fastener means for at least temporarily securing said brackets together to maintain said base means at a desired length, said base means comprising first and second spaced apart ends;

foot control means associated with said base means for contacting the outermost sides of the golfer's feet to train the golfer to confine his weight inside his stance when swinging, said foot control means being foldable between a shipping position in substantially parallel contact with said base means and a deployed position projecting outwardly from said base means generally toward said target line, said foot control means comprising:

a first arm pivotally coupled to said first base means end and adapted to be deployed at an obtuse angle with respect to said base means; and, a second arm pivotally coupled to said second base means end adapted to be deployed at a substantially right angle with respect to said base means; and, positioning means projecting perpendicularly outwardly from said base means between the golfer's feet toward said target line for indicating the proper position of a golf ball to be hit, said positioning means slidably disposed between said first and said second arms.

2. The golf training device as defined in claim 1 wherein each of said brackets comprises a horizontal portion adapted to contact said playing surface and an integral, upwardly extending vertical portion, each vertical portion comprising elongated slots registering with one another and receiving said fastener means and each horizontal portion terminating in ends which limit folding of said first and second arms by contacting portions of said arms to secure them in a desired angular position.

3. A golf stance alignment and training device for developing a proper golf swing, said device comprising:

an extensible base for contacting the golfer's heels and establishing alignment with a target, said base adapted to be disposed on a playing surface behind the golfer and oriented substantially parallel with and spaced apart from a desired target line, said base comprising a pair of elongated angle brackets slidably coupled together, each of said angle brackets comprising a horizontal portion adapted to contact said playing surface and an integral vertical portion adapted to contact the golfer's heels to confine foot movement, said vertical portions comprising elongated slots disposed in registration with one another for receiving a fastener for at least temporarily maintaining said base at a desired, variable length;

first and second foldable foot control arms pivotally coupled to opposite ends of said base for contacting the outer sides of the golfer's feet to restrain foot movement and train the golfer to confine his weight inside his stance when swinging, said arms adapted to assume either a shipping position substantially parallel with said base in a nested relation with one another or a deployed position projecting outwardly from said base toward the target line, said first foot control arm adapted to be deployed at an obtuse angle with respect to said base and said second foot control arm adapted to be disposed at a right angle with respect to said base;

the horizontal portions of said base brackets terminating in ends which limit folding of said first and second arms by contacting portions of said arms to mechanically secure them in the desired angular position; and, an elongated ball positioner projecting perpendicularly outwardly from said base between the golfer's feet and slidably associated with said slots for indicating the position of a golf ball to be hit, said positioner slidably disposable in user-selected positions between said first and said second foot control arms depending upon the golf club to be used.

* * * * *